US009510119B2

(12) United States Patent
Liu

(10) Patent No.: US 9,510,119 B2
(45) Date of Patent: Nov. 29, 2016

(54) METHOD AND DEVICE FOR DETECTING FUNCTION OF LOUDSPEAKER MODULE

(71) Applicants: BOE TECHNOLOGY GROUP CO., LTD., Beijing (CN); K-Tronics (SuZhou) Technology Co., Ltd, Suzhou, Jiangsu Province (CN)

(72) Inventor: Bao Liu, Beijing (CN)

(73) Assignees: BOE TECHNOLOGY GROUP CO., LTD., Beijing (CN); K-TRONICS (SUZHOU) TECHNOLOGY CO., LTD., Suzhou, Jiangsu Province (CN)

( * ) Notice: Subject to any disclaimer, the term of this patent is extended or adjusted under 35 U.S.C. 154(b) by 0 days.

(21) Appl. No.: 14/741,903

(22) Filed: Jun. 17, 2015

(65) Prior Publication Data

US 2016/0277859 A1 Sep. 22, 2016

(30) Foreign Application Priority Data

Mar. 16, 2015 (CN) ..... 2015 1 0114087

(51) Int. Cl.
*H04R 29/00* (2006.01)
*H04R 3/00* (2006.01)

(52) U.S. Cl.
CPC ..... *H04R 29/001* (2013.01); *H04R 3/007* (2013.01)

(58) Field of Classification Search
CPC ..... H04R 29/001; H04R 3/007
USPC ..... 324/133; 330/2, 134; 340/256; 381/18, 381/55, 59; 600/559; 181/169; 455/557
See application file for complete search history.

(56) References Cited

U.S. PATENT DOCUMENTS 3,849,772 A * 11/1974 Burnett ..... G01R 31/026 324/539
4,009,707 A * 3/1977 Ward ..... A61B 5/121 600/559
4,552,243 A * 11/1985 Melillo ..... H04R 7/02 181/169
4,947,110 A * 8/1990 Laass ..... G01R 31/026 324/133
5,216,379 A * 6/1993 Hamley ..... H03F 1/0266 330/134
5,719,526 A * 2/1998 Fink ..... H03F 1/34 324/713
2005/0163326 A1* 7/2005 Heuer ..... H04R 29/001 381/59
2005/0286727 A1* 12/2005 Otsuka ..... H04R 5/02 381/18
2006/0142062 A1* 6/2006 Eder ..... H04B 1/3877 455/557
2013/0251165 A1* 9/2013 Jorgensen ..... H04R 29/001 381/59
2016/0277859 A1* 9/2016 Liu ..... H04R 3/007

* cited by examiner

*Primary Examiner* — Gerald Gauthier
(74) *Attorney, Agent, or Firm* — Nath, Goldberg & Meyer; Joshua B. Goldberg; Christopher Thomas

(57) ABSTRACT

The present invention provides a method and a device for detecting function of a loudspeaker module, belonging to the field of detection technology and being capable of solving the problems of noise interference, inaccurate detection result and high manpower consumption in existing function detection of the loudspeaker module. According to the method and the device for detecting the function of the loudspeaker module in the present invention, a test resistor is adopted to substitute a mode that a loudspeaker is directly connected to a test circuit, so that noise-free and automatic detection of the function of the loudspeaker module is realized.

8 Claims, 4 Drawing Sheets

METHOD AND DEVICE FOR DETECTING FUNCTION OF LOUDSPEAKER MODULE

FIELD OF THE INVENTION

The present invention belongs to the field of detection technology, and specifically relates to a method and a device for detecting the function of a loudspeaker module.

BACKGROUND OF THE INVENTION

The function detection of a loudspeaker module not only involves perfection detection of a single interface, but more importantly, whether the function of an audio module in loudspeaker front-end device is normal is judged by detecting the signal of a loudspeaker interface, wherein the audio module includes an audio generating source module, an audio transmission channel and an audio control module. Thus, the function detection of the loudspeaker interface is substantially to judge whether the function of the audio module of the loudspeaker module is normal. Before overall assembly, the function of the loudspeaker module of a product in which the loudspeaker is arranged is detected, so that defective audio module products may be effectively prevented from entering the subsequent assembly stage, then the reject ratio of the overall product is controlled, and the production cost is reduced.

At present, the most common method for detecting the function of the loudspeaker module includes the steps of directly connecting the loudspeaker to a detection interface and then judging whether the loudspeaker produces sound by human ears to determine whether the function of the audio module is normal. This method is most direct and convenient. However, generally, a plurality of loudspeaker modules need to be simultaneously detected in the detection process. Accordingly, the sound simultaneously produced by the plurality of loudspeaker modules is liable to generate acoustic interference to human ears, so that the detection result is inaccurate and the detection process needs a large amount of manpower.

SUMMARY OF THE INVENTION

An object of the present invention is to solve the problems of noise interference, inaccurate detection result and high manpower consumption in the function detection of a loudspeaker module in the prior art and to provide a noise-free and automatic method and device for detecting the function of a loudspeaker module.

The technical solution adopted for solving the above technical problems involves a method for detecting function of a loudspeaker module, including the following steps:

a voltage signal acquisition step, for connecting a test resistor to an interface of the loudspeaker module to form a circuit, and continuously acquiring voltages at two ends of the test resistor respectively within a predetermined time to obtain two groups of voltage signal values $V_1(t)$ and $V_2(t)$;

a voltage difference calculation step, for calculating difference between the two groups of voltage signal values $V_1(t)$ and $V_2(t)$ to obtain a voltage difference V(t) at the two ends of the test resistor;

a current frequency value f and current amplitude A calculation step, for calculating frequency value f and amplitude A of current flowing through the test resistor according to the voltage difference V(t); and a loudspeaker module function judgment step, for calculating differences between the amplitude A and the frequency value f of the current flowing through the test resistor and respective reference values $A_b$ and $f_b$, judging that the function of the loudspeaker module to be detected is normal if the differences are within the ranges of preset error thresholds, otherwise, judging that the function is abnormal.

Preferably, the current frequency value f and current amplitude A calculation step includes: performing calculating according to data of the voltage difference V(t) and the following formulas to obtain frequency value f and amplitude A:

$$f=f_v;$$

$$A=(V(t)_{max}-V(t)_{min})/2R,$$

where $f_v$ is frequency of the voltage difference V(t), R is the resistance of the test resistor, and $V(t)_{max}$ and $V(t)_{min}$ are maximum and minimum of the voltage difference V(t) respectively.

Preferably, the loudspeaker module function judgment step further includes: setting the error range of the amplitude A of the current flowing through the test resistor to be $[A_{min}, A_{max}]$, and setting the error range of the frequency value f of the current flowing through the test resistor to be $[F_{min}, F_{max}]$; and if the frequency value f and amplitude A of the current flowing through the test resistor respectively satisfy the following two formulas, judging that the function of the loudspeaker module is normal, otherwise, judging that the function is abnormal:

$$A_{min}\leq A-A_b\leq A_{max};$$

$$F_{min}\leq f-f_b\leq F_{max}.$$

Preferably, the test resistor is a ceramic insulating power type wire wound resistor.

The present invention further provides a device for detecting function of a loudspeaker module, including:

a voltage signal acquisition unit, configured to continuously acquire voltages at two ends of a test resistor respectively within a predetermined time to obtain two groups of voltage signal values $V_1(t)$ and $V_2(t)$; and a data processing unit, configured to process the two groups of voltage signal values $V_1(t)$ and $V_2(t)$ acquired by the voltage signal acquisition unit and judge whether the function of the loudspeaker module is normal.

Preferably, the data processing unit includes:

a voltage difference calculation subunit, configured to calculate difference between the two groups of voltage signal values $V_1(t)$ and $V_2(t)$ to obtain a voltage difference V(t) at the two ends of the test resistor;

a current frequency value f and current amplitude A calculation subunit, configured to calculate the frequency value f and the amplitude A of current flowing through the test resistor according to the voltage difference V(t); and a loudspeaker module function judgment subunit, configured to calculate the differences between the amplitude A and the frequency value f of the current flowing through the test resistor and respective reference values $A_b$ and $f_b$, judge that the function of the loudspeaker module to be detected is normal if the differences are within the ranges of preset error thresholds, otherwise, judge that the function is abnormal.

Preferably, the current frequency value f and current amplitude A calculation subunit is also configured to perform calculating according to data of the voltage difference V(t) and the following formulas to obtain frequency value f and amplitude A:

$$f=f_v;$$

$$A=(V(t)_{max}-V(t)_{min})/2R,$$

where $f_v$ is frequency of the voltage difference V(t), R is the resistance of the test resistor, and $V(t)_{max}$ and $V(t)_{min}$ are maximum and minimum of the voltage difference V(t) respectively.

Preferably, the loudspeaker module function judgment subunit is also configured to set error range of the amplitude A of the current flowing through the test resistor to be [$A_{min}$, $A_{max}$], and set error range of the frequency value f of the current flowing through the test resistor to be [$F_{min}$, $F_{max}$]; and if the frequency value f and the amplitude A of the current flowing through the test resistor respectively satisfy the following two formulas, judge that the function of the loudspeaker module is normal, otherwise, judge that the function is abnormal:

$$A_{min} \leq A-A_b \leq A_{max};$$

$$F_{min} \leq f-f_b \leq F_{max}.$$

According to the method and the device for detecting the function of the loudspeaker module in the present invention, the test resistor is adopted to substitute a mode that a loudspeaker is directly connected to a test circuit, so that noise-free and automatic detection of the function of the loudspeaker module is realized; and the problems of noise interference, inaccurate detection result and high manpower consumption in the function detection of a loudspeaker module in the prior art are solved.

DETAILED DESCRIPTION OF THE EMBODIMENTS

To make the person skilled in the art better understand the technical solutions of the present invention, the present invention will be further described in detail below in combination with the accompanying drawings and specific embodiments.

Figure 1:
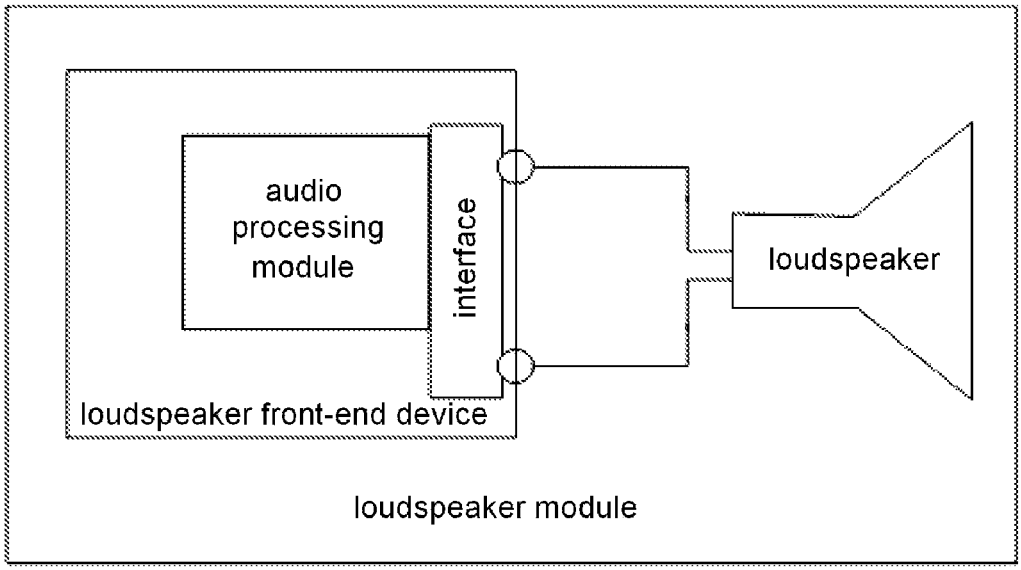
FIG. 1 is a schematic block diagram of a structure of a loudspeaker module in the prior art.
Figure 2:
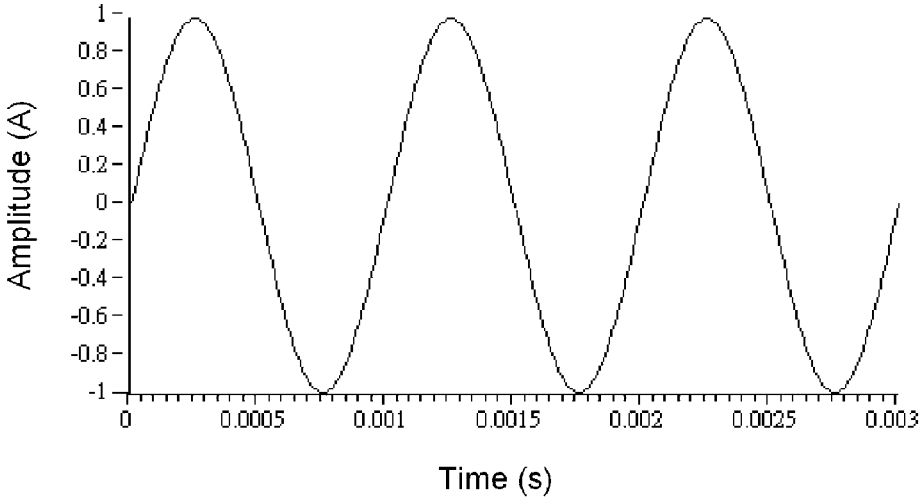
FIG. 2 is a waveform diagram of an audio signal generated by the loudspeaker module and having a fixed frequency.

As shown in FIG. 1, a loudspeaker module includes loudspeaker front-end device and a loudspeaker. The waveform of an audio signal generated by the loudspeaker front-end device and having a fixed frequency is shown as FIG. 2, and the generated audio signal with the fixed frequency is transmitted to the loudspeaker through an interface, so that the loudspeaker produces sound.

The function of the loudspeaker module, particularly whether the function of an audio module is normal, is generally judged according to the volume and pitch of the sound produced by the loudspeaker. Taking a most widely used electric loudspeaker as an example, the loudspeaker produces sound when a vibrating diaphragm vibrates due to an electric force P of a magnetic field on a current carrying conductor, so the volume is directly proportional to the P, and the pitch is directly proportional to the frequency of the change of P, wherein the electric force P(t)=BLI(t), L is the length of a voice coil conducting wire, B is magnetic induction intensity in a magnetic gap, and I is current flowing through a voice coil.

Since the volume and the pitch of the sound emitted from the loudspeaker are directly proportional to the amplitude and the frequency of the current flowing through the loudspeaker, the measurement of the volume and the pitch of the sound emitted from the loudspeaker may be equivalent to the measurement of the amplitude and the frequency of the current.

Figure 3:
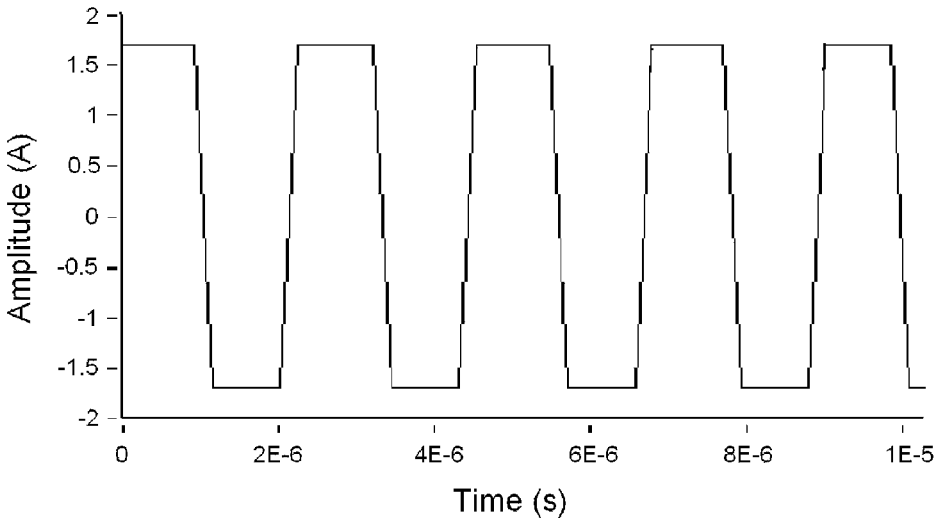
FIG. 3 is a waveform diagram of a voltage signal at an interface when the interface of the loudspeaker module is no-load.

If the interface is no-load, a current circuit is not formed at the two ends of the interface, and the waveform of a voltage signal at the interface is as shown in FIG. 3.

Figure 4:
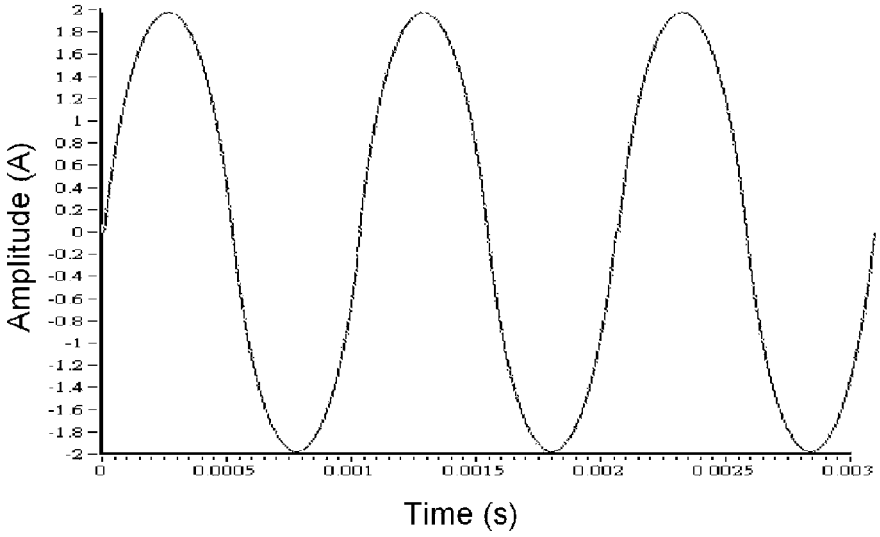
FIG. 4 is a waveform diagram of a voltage signal at the interface when the interface of the loudspeaker module is connected with a loudspeaker.

If the interface is loaded, namely connected with the loudspeaker, a current circuit is formed at the two ends of the interface, and the waveform of a voltage differential signal at the interface is as shown in FIG. 4.

It could be seen from FIG. 3 and FIG. 4 that, the voltage signal at the interface when the interface is no-load is greatly different from that when the loudspeaker is connected to the interface to form a circuit.

Thus, the function of the loudspeaker module must be detected when a load is connected. According to the characteristic that the loudspeaker has fixed impedance when inputting a signal with fixed frequency, the test resistor is used as a load to substitute the loudspeaker, so that the requirement for a load required for detecting the function of the loudspeaker module can be met and noise is not produced at the same time.

Preferably, a ceramic insulating power type wire wound resistor may be selected as the test resistor. The ceramic insulating power type wire wound resistor has the characteristics of high load power and small temperature coefficient. More preferably, the ceramic insulating power type wire wound resistor having the same resistance and power as the loudspeaker can be selected as a load to detect the function of the loudspeaker module.

Embodiment 1

Figure 5:
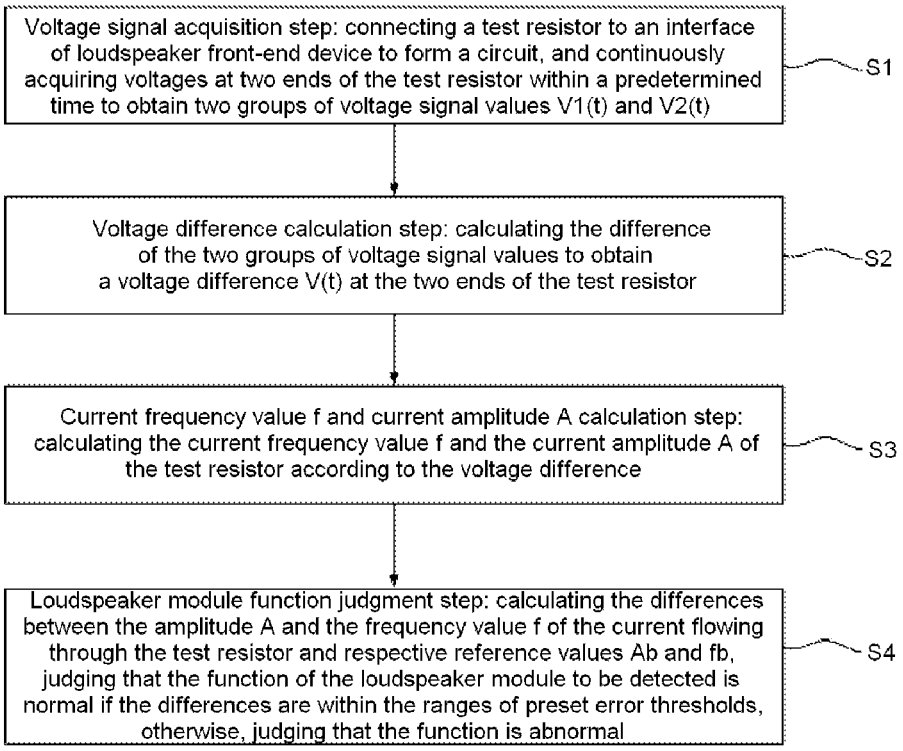
FIG. 5 is a schematic flow diagram of steps of a method for detecting the function of a loudspeaker module according to an embodiment of the present invention.
Figure 6:
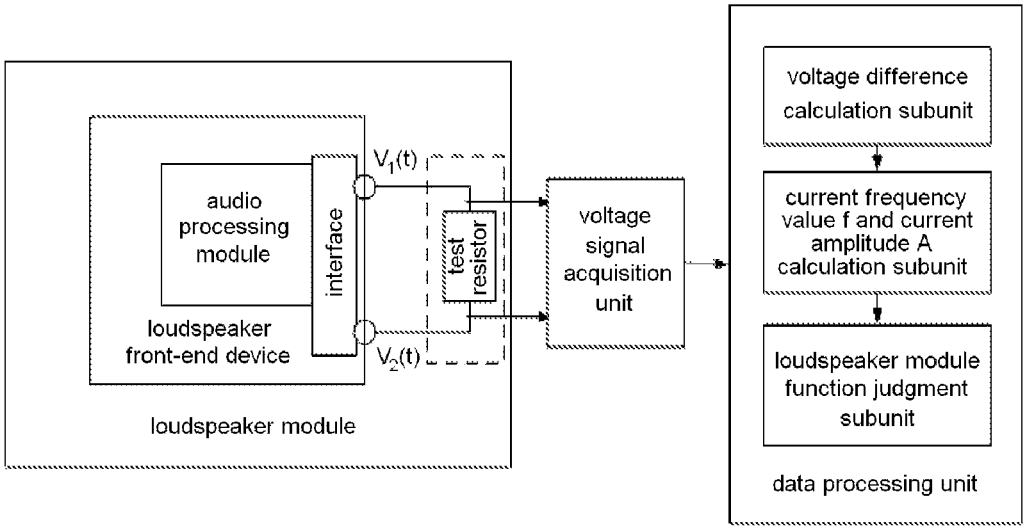
FIG. 6 is a schematic block diagram of a structure of a device for detecting the function of a loudspeaker module according to another embodiment of the present invention.
Figure 7:
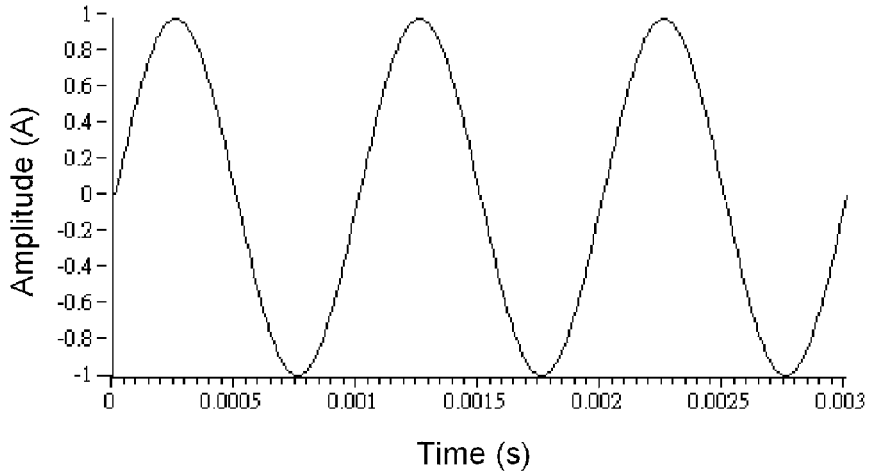
FIG. 7 is a waveform diagram of a voltage signal of an interface of the loudspeaker module.
Figure 8:
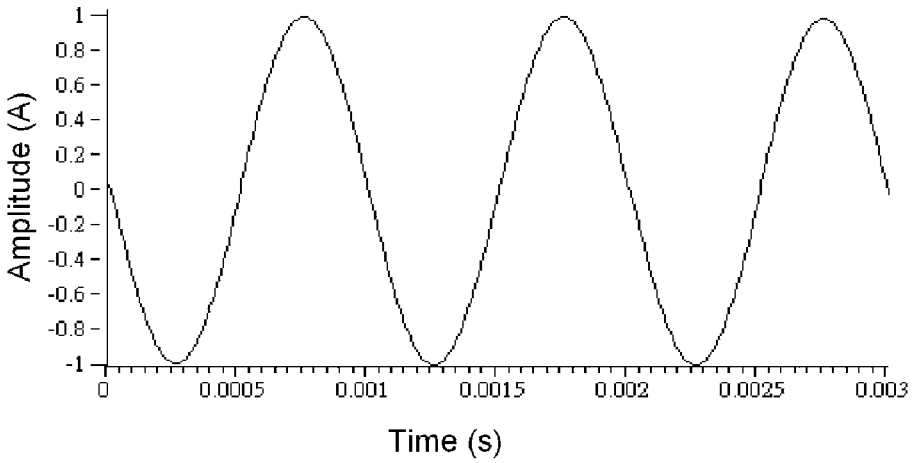
FIG. 8 is a waveform diagram of a voltage signal of another interface of the loudspeaker module.

As shown in FIG. 5, this embodiment provides a method for detecting the function of a loudspeaker module, including the following steps:

S1, a voltage signal acquisition step, for connecting a test resistor to an interface of the loudspeaker module to form a circuit (as shown in FIG. 6), and continuously acquiring voltages at two ends of the test resistor respectively within a predetermined time to obtain two groups of voltage signal values $V_1(t)$ and $V_2(t)$ (as shown in FIG. 7 and FIG. 8);

S2, a voltage difference calculation step, for calculating the difference of the two groups of voltage signal values $V_1(t)$ and $V_2(t)$ to obtain a voltage difference V(t) of the test resistor;

S3, a current frequency value f and current amplitude A calculation step, for calculating the frequency value f and the amplitude A of current flowing through the test resistor according to the voltage difference V(t); and S4, a loudspeaker module function judgment step, for calculating the differences between the calculated amplitude A and frequency value f of the current flowing through the test resistor and respective reference values $A_b$ and $f_b$, judging that the function of the loudspeaker module to be detected is normal if the differences are within the ranges of preset error thresholds, otherwise, judging that the function is abnormal.

Noise-free and automatic detection of the function of the loudspeaker module can be realized by the above method.

The operation process of the method for detecting the function of the loudspeaker module according to this embodiment will be described below through a specific example.

The test resistor is connected between two ends of an interface of the loudspeaker module to form a circuit, and the loudspeaker module to be detected produces an audio signal S(t) with fixed frequency and amplitude. Under such a condition, voltages at two ends of the test resistor are respectively and continuously acquired within 2 s to obtain two groups of voltage signal values $V_1(t)$ and $V_2(t)$. It should be understood that, the test time may be adjusted according to specific conditions, but not limited to 2 s in this example.

The difference of $V_1(t)$ and $V_2(t)$ is calculated to obtain a voltage difference $V(t)=V_1(t)-V_2(t)$ at the two ends of the test resistor. The relation between S(t) and $V_1(t)$ and $V_2(t)$ satisfies formula (1), wherein a is a constant:

$$S(t)=a*V(t) \quad (1).$$

Since the audio signal S(t) of a signal source has a fixed frequency, the value of which is a constant $f_s$, the frequencies $f_{v1}$ and $f_{v2}$ of the voltages $V_1(t)$ and $V_2(t)$ at the two ends of the test resistor and the frequency $f_s$ of the audio signal S(t) satisfy formula (2):

$$f_s=f_{v1}=f_{v2} \quad (2).$$

Under the condition that the function of the loudspeaker module is normal, the frequency $f_v$ of the voltage difference V(t) at the two ends of the test resistor satisfies formula (3):

$$f_v=f_{v1}=f_{v2} \quad (3).$$

The current flowing through the test resistor may be expressed as:

$$I(t)=(V_1(t)-V_2(t)/R=S(t)/(a*R) \quad (4),$$

where R is the resistance of the test resistor. That is, under the condition that the function of the loudspeaker module is normal, the amplitude of the current I(t) is proportional to the amplitude of the audio signal S(t).

The current flowing through the test resistor may be calculated according to the obtained voltage difference V(t) at the two ends of the test resistor and the known resistance R of the test resistor. Specifically, from the following formula (5):

$$V(t)=A\sin(2\pi f t+\theta)R \quad (5),$$

it could be known that the frequency of the current I(t) is equal to that of the voltage difference V(t) at the two ends of the test resistor, and also equal to that of the audio signal S(t); where θ is an initial phase.

Thus, the frequency of the current I(t) may be obtained by the following formula:

$$f=f_v=f_s \quad (6).$$

The value of the frequency $f_v$ may be obtained by any existing method. For example, the frequency $f_v$ of the voltage may be obtained by collecting the voltage values at the two ends of the test resistor using a voltage acquisition card and performing corresponding calculation, and thus the value of the frequency f flowing through the test resistor is obtained.

From the formula (5), it could be also known that the amplitude A of the current is proportional to the value of the voltage. Specifically, the amplitude A of the current I(t) may be calculated according to the following formula:

$$A=(V(t)_{max}-V(t)_{min})/2R \quad (7),$$

where $V(t)_{max}$ and $V(t)_{min}$ are maximum and minimum of the voltage difference V(t) respectively; $(V(t)_{max}-V(t)_{min})/2$ is the amplitude of the voltage difference V(t).

The values of $V(t)_{max}$ and $V(t)_{min}$ may be obtained by any existing method. For example, the maximum and minimum $V(t)_{max}$ and $V(t)_{min}$ of the voltage difference V(t) may be obtained by collecting the voltage values at the two ends of the test resistor using a voltage acquisition card and performing corresponding calculation.

Reference values of the frequency value f and the amplitude A of the current flowing through the test resistor will be determined below.

A piece of test qualified loudspeaker device is selected. According to the above method, respective voltage signals at the two ends of the test resistor are continuously measured within 2 s, and the average amplitude of the current flowing through the test resistor is calculated as a current amplitude reference value $A_b$.

At the moment, since the frequency value f of the current is equal to the frequency fs of the audio signal S(t) of the signal source, $f_s$ may be used as the frequency reference value $f_b$ of the current flowing through the test resistor, namely $f_b=f_s$.

According to a specific application scenario, an error range $[A_{min}, A_{max}]$ of the amplitude A of the current flowing through the test resistor and an error range $[F_{min}, F_{max}]$ of the frequency value f of the current flowing through the test resistor are set.

Then, the calculated frequency value f and amplitude A of the current flowing through the test resistor are compared with respective reference values. If the frequency value f and the amplitude A of the current flowing through the test resistor respectively satisfy the following two formulas, the function of the loudspeaker module is normal, otherwise, the function is abnormal:

$$A_{min}\le A-A_b\le A_{max};$$

$$F_{min}\le f-f_b\le F_{max}.$$

Noise-free and automatic detection of the function of the loudspeaker module to be detected is realized through the above steps.

Embodiment 2

As shown in FIG. 6, this embodiment provides a device for detecting the function of a loudspeaker module, including a voltage signal acquisition unit and a data processing unit.

The voltage signal acquisition unit is configured to continuously acquire voltages at two ends of a test resistor respectively within a predetermined time to obtain two groups of voltage signal values $V_1(t)$ and $V_2(t)$, wherein the two groups of voltage signals are respectively shown as FIG. 7 and FIG. 8. Specifically, a data acquisition card AS416 may be used as the voltage signal acquisition unit.

The data processing unit is configured to process the two groups of voltage signal values $V_1(t)$ and $V_2(t)$ acquired by the voltage signal acquisition unit and judge whether the function of the loudspeaker module is normal. In practical application, the data processing unit may be a data processing platform, e.g. a computer loaded with Lab VIEW software.

Preferably, the data processing unit includes:

a voltage difference calculation subunit, configured to calculate the difference of the two groups of voltage signal values $V_1(t)$ and $V_2(t)$ to obtain a voltage difference V(t) at the two ends of the test resistor;

a current frequency value f and current amplitude A calculation subunit, configured to calculate the frequency value f and the amplitude A of current flowing through the test resistor according to the voltage difference V(t); and a loudspeaker module function judgment subunit, configured to calculate the differences between the amplitude A and the frequency value f of the current flowing through the test resistor and respective reference values $A_b$ and $f_b$, judge that the function of the loudspeaker module to be detected is normal if the differences are within the ranges of preset error thresholds, otherwise, judge that the function is abnormal.

Preferably, the current frequency value f and current amplitude A calculation subunit is configured to perform calculating according to the data of V(t) and the following formula to obtain frequency value f and amplitude A:

$$f=f_v=f_s \quad (6);$$

$$A=(V(t)_{max}-V(t)_{min})/2R \quad (7).$$

Preferably, the loudspeaker module function judgment subunit is also configured to set the error range of the amplitude A of the current to be $[A_{min}, A_{max}]$ and set the error range of the frequency value f of the current to be $[F_{min}, F_{max}]$.

If the current frequency value f and the current amplitude A of the test resistor respectively satisfy the following two formulas, the function of the loudspeaker module is normal, otherwise, the function is abnormal:

$$A_{min}\leq A-A_b\leq A_{max};$$

$$F_{min}\leq f-f_b\leq F_{max}.$$

The reference values of the current frequency value f and the current amplitude A of the test resistor are set according to the following method:

selecting a piece of test qualified loudspeaker device, then according to the above method, continuously measuring voltage signals at the two ends of the test resistor respectively within 2 s, and calculating the average amplitude of the current flowing through the test resistor as a current amplitude reference value $A_b$; and at the moment, since the current frequency value f is equal to the frequency fs of the audio signal S(t) of the signal source, using $f_s$ as the current frequency reference value $f_b$ of the test resistor, namely $f_b=f_s$.

Noise-free and automatic detection of the function of the loudspeaker module to be detected is realized through the device for detecting the function of the loudspeaker module in the present invention.

It could be understood that, the above embodiments are merely exemplary embodiments adopted for describing the principle of the present invention, however, the present invention is not limited thereto. Various modifications and improvements may be made for the person having ordinary skill in the art without departing from the spirit and essence of the present invention, and these modifications and improvements are considered to be within the protection scope of the present invention.

The invention claimed is:

1. A method for detecting function of a loudspeaker module, comprising the following steps:

a voltage signal acquisition step, for connecting a test resistor to an interface of the loudspeaker module to form a circuit, and continuously acquiring voltages at two ends of the test resistor respectively within a predetermined time to obtain two groups of voltage signal values $V_1(t)$ and $V_2(t)$;

a voltage difference calculation step, for calculating difference between the two groups of voltage signal values $V_1(t)$ and $V_2(t)$ to obtain a voltage difference V(t) at the two ends of the test resistor;

a current frequency value f and current amplitude A calculation step, for calculating frequency value f and amplitude A of current flowing through the test resistor according to the voltage difference V(t); and a loudspeaker module function judgment step, for calculating differences between the amplitude A and the frequency value f of the current flowing through the test resistor and respective reference values $A_b$ and $f_b$, judging that the function of the loudspeaker module to be detected is normal if the differences are within the ranges of preset error thresholds, otherwise, judging that the function is abnormal.

2. The method for detecting the function of the loudspeaker module of claim 1, wherein the current frequency value f and current amplitude A calculation step comprises: performing calculating according to data of the voltage difference V(t) and the following formulas to obtain the frequency value f and the amplitude A:

$$f=f_v;$$

$$A=(V(t)_{max}-V(t)_{min})/2R,$$

where $f_v$ is frequency of the voltage difference V(t), R is the resistance of the test resistor, and $V(t)_{max}$ and $V(t)_{min}$ are maximum and minimum of the voltage difference V(t) respectively.

3. The method for detecting the function of the loudspeaker module of claim 1, wherein the loudspeaker module function judgment step further comprises: setting error range of the amplitude A of the current flowing through the test resistor to be $[A_{min}, A_{max}]$, and setting error range of the frequency value f of the current flowing through the test resistor to be $[F_{min}, F_{max}]$; and if the obtained frequency value f and amplitude A of the current flowing through the test resistor respectively satisfy the following two formulas, judging that the function of the loudspeaker module is normal, otherwise, judging that the function is abnormal:

$$A_{min}\leq A-A_b\leq A_{max};$$

$$F_{min}\leq f-f_b\leq F_{max}.$$

4. The method for detecting the function of the loudspeaker module of claim 1, wherein the test resistor is a ceramic insulating power type wire wound resistor.

5. A device for detecting function of a loudspeaker module, the loudspeaker module includes a loudspeaker front-end device and an interface to which a loudspeaker is connected, and in a case of detecting function of the loudspeaker module, a test resistor is connected to the interface to substitute the loudspeaker, the device comprising:

a voltage signal acquisition unit, configured to continuously acquire voltages at two ends of the test resistor respectively within a predetermined time to obtain two groups of voltage signal values $V_1(t)$ and $V_2(t)$; and a data processing unit, configured to process the two groups of voltage signal values $V_1(t)$ and $V_2(t)$ acquired by the voltage signal acquisition unit and judge whether the function of the loudspeaker module is normal.

6. The device for detecting the function of the loudspeaker module of claim 5, wherein the data processing unit comprises:

a voltage difference calculation subunit, configured to calculate difference between the two groups of voltage signal values $V_1(t)$ and $V_2(t)$ to obtain a voltage difference V(t) at the two ends of the test resistor;

a current frequency value f and current amplitude A calculation subunit, configured to calculate the frequency value f and the amplitude A of current flowing through the test resistor according to the voltage difference V(t); and a loudspeaker module function judgment subunit, configured to calculate differences between the amplitude A and the frequency value f of the current flowing through the test resistor and respective reference values $A_b$ and $f_b$, judge that the function of the loudspeaker module to be detected is normal if the differences are within the ranges of preset error thresholds, otherwise, judge that the function is abnormal.

7. The device for detecting the function of the loudspeaker module of claim 6, wherein the current frequency value f and current amplitude A calculation subunit is also configured to perform calculating according to data of the voltage difference V(t) and the following formulas to obtain the frequency value f and the amplitude A:

$$f=f_v;$$

$$A=(V(t)_{max}-V(t)_{min})/2R,$$

where $f_v$ is frequency of the voltage difference V(t), R is the resistance of the test resistor, and $V(t)_{max}$ and $V(t)_{min}$ are maximum and minimum of the voltage difference V(t) respectively.

8. The device for detecting the function of the loudspeaker module of claim 6, wherein the loudspeaker module function judgment subunit is also configured to set error range of the amplitude A of the current flowing through the test resistor to be $[A_{min}, A_{max}]$, and set error range of the frequency value f of the current flowing through the test resistor to be $[F_{min}, F_{max}]$;

if the frequency value f and the amplitude A of the current flowing through the test resistor respectively satisfy the following two formulas, the function of the loudspeaker module is normal, otherwise, the function is abnormal:

$$A_{min}\leq A-A_b\leq A_{max};$$

$$F_{min}\leq f-f_b\leq F_{max}.$$

* * * * *